US009549615B1

(12) United States Patent
Su

(10) Patent No.: US 9,549,615 B1
(45) Date of Patent: Jan. 24, 2017

(54) RETRACTABLE LEG REST FOR CHAIR

(71) Applicant: Chih-Cheng Su, Dongguan (CN)

(72) Inventor: Chih-Cheng Su, Dongguan (CN)

(73) Assignee: DONGGUAN KENTEC OFFICE SEATING CO., LTD., Dongguan (CN)

( * ) Notice: Subject to any disclaimer, the term of this patent is extended or adjusted under 35 U.S.C. 154(b) by 0 days.

(21) Appl. No.: 14/842,976

(22) Filed: Sep. 2, 2015

(51) Int. Cl.
*A47C 7/50* (2006.01)

(52) U.S. Cl.
CPC ..... *A47C 7/506* (2013.01)

(58) Field of Classification Search
CPC ..... A47C 7/506
USPC ..... 297/452.28, 423.28
See application file for complete search history.

(56) References Cited

U.S. PATENT DOCUMENTS 6,155,645 A * 12/2000 Bedrich ..... A47C 1/0355 297/423.28 X
6,572,185 B1 * 6/2003 Tseng ..... A47C 1/0355 297/69
7,080,887 B2 * 7/2006 Tseng ..... A47C 1/035 297/423.28 X
7,429,083 B2 * 9/2008 Tsuji ..... B60N 2/4495 297/423.28 X
8,444,226 B2 * 5/2013 Driessen ..... B60N 2/4495 297/423.28
8,944,513 B2 * 2/2015 Suzuki ..... B60N 3/063 297/423.28 X
2009/0273220 A1 * 11/2009 Kim ..... B60N 2/4495 297/423.28
2010/0052395 A1 * 3/2010 Anglese ..... A47C 7/506 297/423.3
2010/0102612 A1 * 4/2010 Walters ..... A47C 7/506 297/423.19 X
2013/0341989 A1 * 12/2013 Lin ..... A47C 7/506 297/423.28
2015/0305507 A1 * 10/2015 Besler ..... A47C 7/506 297/423.28

* cited by examiner

*Primary Examiner* — Rodney B White

(57) ABSTRACT

The leg rest includes a base frame and a retractable frame assembly. The base frame has a through hole and two connecting sockets. A connecting rod connects between the connecting sockets. Two hole seats are provided on the connecting rod. The retractable frame assembly connects with the base frame and includes a first support frame having two connecting arms and a main board connected therebetween. The connecting arms separately connect the connecting sockets. A link with a connecting tube perpendicularly extends from the main board. The connecting tube is coaxially connected between the hole seats. A second support frame rotatably connects to the main board. A support seat rotatably connects to the second support frame and has a transversal rod. A vertical rod is perpendicularly connected between the transversal rod and the main board. A support pad is fixed onto the support seat.

9 Claims, 6 Drawing Sheets

RETRACTABLE LEG REST FOR CHAIR

BACKGROUND OF THE INVENTION

1. Technical Field

The invention relates to chairs, particularly to a chair with a leg rest.

2. Related Art

Office chairs with a cushion elevation mechanism and/or flexible back have been very popular. Although many chairs are provided with a flexible back with tilt flexibility, height position of the back cannot be adjusted to satisfy various users with different body length. Although existing chairs are very comfortable for users, almost all office chairs do not provide a leg rest for supporting a user's calves to allow a user to stretch his or her legs.

SUMMARY OF THE INVENTION

An object of the invention is to provide a retractable leg rest for a chair, which can be stretched to support a user's calves and keep his or her legs horizontal when needed and can be retracted when not needed.

To accomplish the above object, the retractable leg rest for a chair of the invention includes a base frame and a retractable frame assembly. The base frame has a through hole and two connecting sockets. A connecting rod connects between the connecting sockets. Two hole seats are provided on the connecting rod. The retractable frame assembly connects with the base frame and includes a first support frame having two connecting arms and a main board connected therebetween. The connecting arms separately connect the connecting sockets. A link with a connecting tube perpendicularly extends from the main board. The connecting tube is coaxially connected between the hole seats. A second support frame rotatably connects to the main board. A support seat rotatably connects to the second support frame and has a transversal rod. A vertical rod is perpendicularly connected between the transversal rod and the main board. A support pad is fixed onto the support seat.

DETAILED DESCRIPTION OF THE INVENTION

Figure 1:
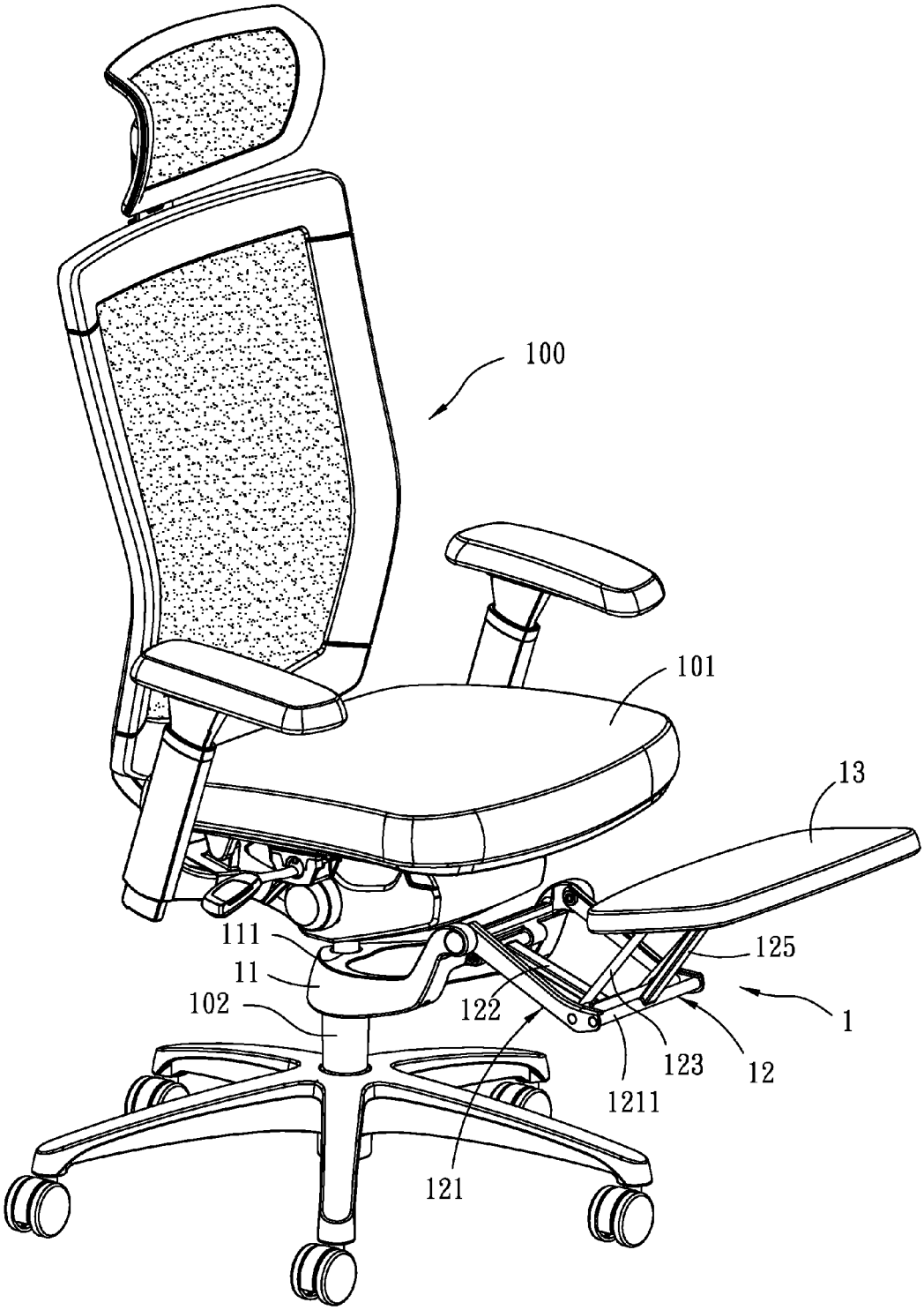
FIG. 1 is a schematic view of the invention assembled with a chair.
Figure 2:
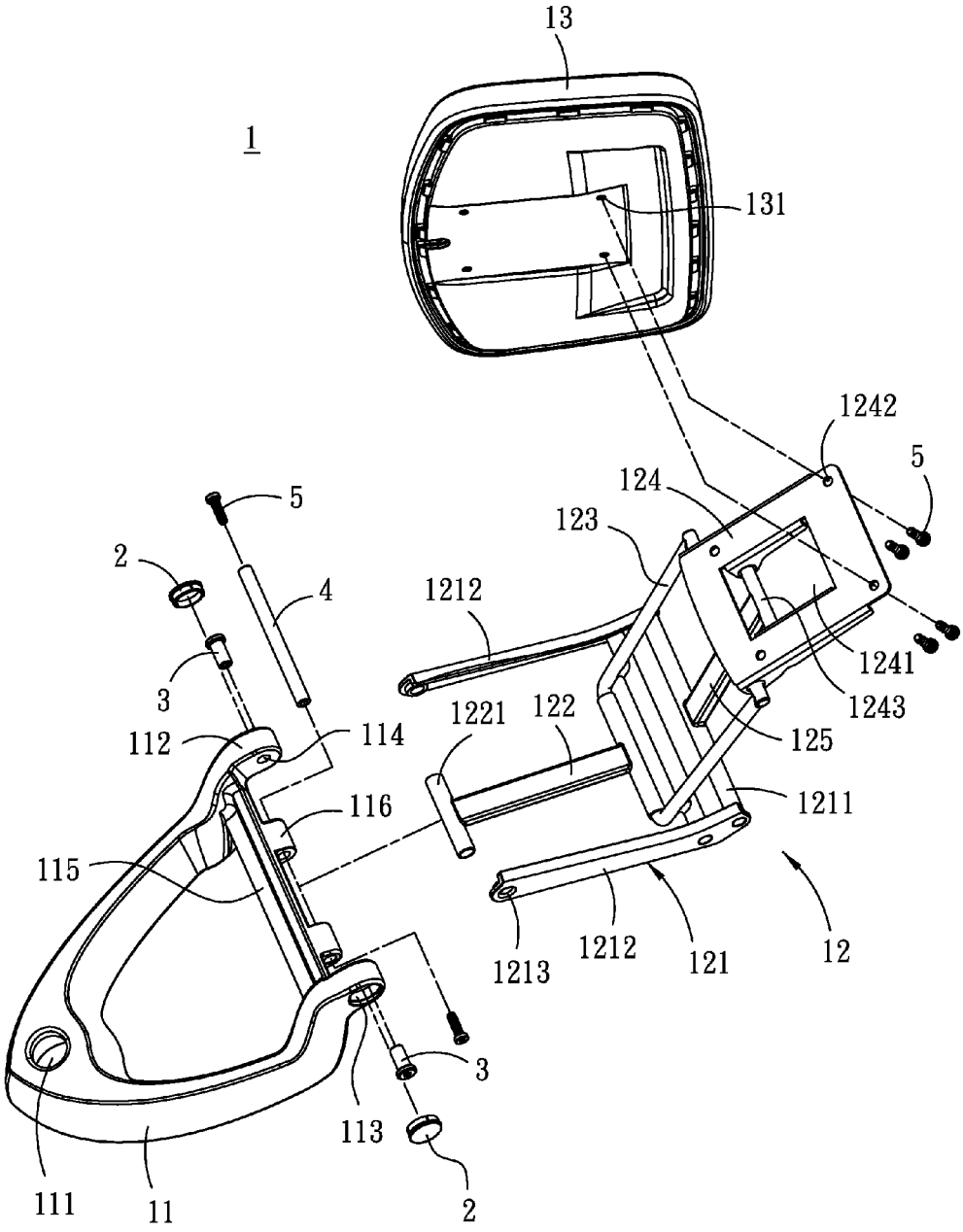
FIG. 2 is an exploded view of the invention.

Please refer to FIGS. 1 and 2. As shown, the retractable leg rest 1 of the invention is installed under a cushion 101 of a chair 100 and fastened onto a post 102. The leg rest 1 primarily includes a base frame 11, a retractable frame assembly 12 and a support pad 13.

The base frame 11 is of a U-shape. An end of the base frame 11 is formed with a through hole 111 for being passed through by the post 102 of the chair 100. The other end of the base frame 11 is formed with two connecting sockets 112 which are axially symmetrical. Each of the connecting sockets 112 is formed with a pivot hole 113 with a cap 2. The pivot hole 113 is further formed with a threaded hole 114 for screwing with a bolt 3. A connecting rod 115 is provided to connect between the connecting sockets 112. Two hole seats 116 are provided on the connecting rod 115.

Please refer to FIG. 2. The retractable frame assembly 12 is rotatably connected with the base frame 11 and includes a first support frame 121, a second support frame 123, a support seat 124 and a vertical rod 125. The first support frame 121 has two connecting arms 1212 and a main board 1211 connected therebetween. An end of each connecting arm 1212 is formed with a passing hole 1213. The connecting arms 1212 are separately connected to the connecting sockets 112 by inserting the bolt 3 through the passing hole 1213 and pivot hole 113 and screwing the bolt 3 into the threaded hole 114. A link 122 perpendicularly extends from the main board 1211. The link 122 is parallel with the connecting arms 1212. An outer end of the link 122 is provided with a connecting tube 1221. The connecting tube 1221 is coaxially sandwiched between the hole seats 116. A shaft 4 is inserted through the hole seats 116 and the connecting tube 1221 to make the link 122 rotatable with respect to the hole seats 116. Two ends of the shaft 4 are separately fastened with two screws 5 to hold the shaft 4 and keep the link 122 rotatable with respect to the connecting rod 115.

Figure 3:
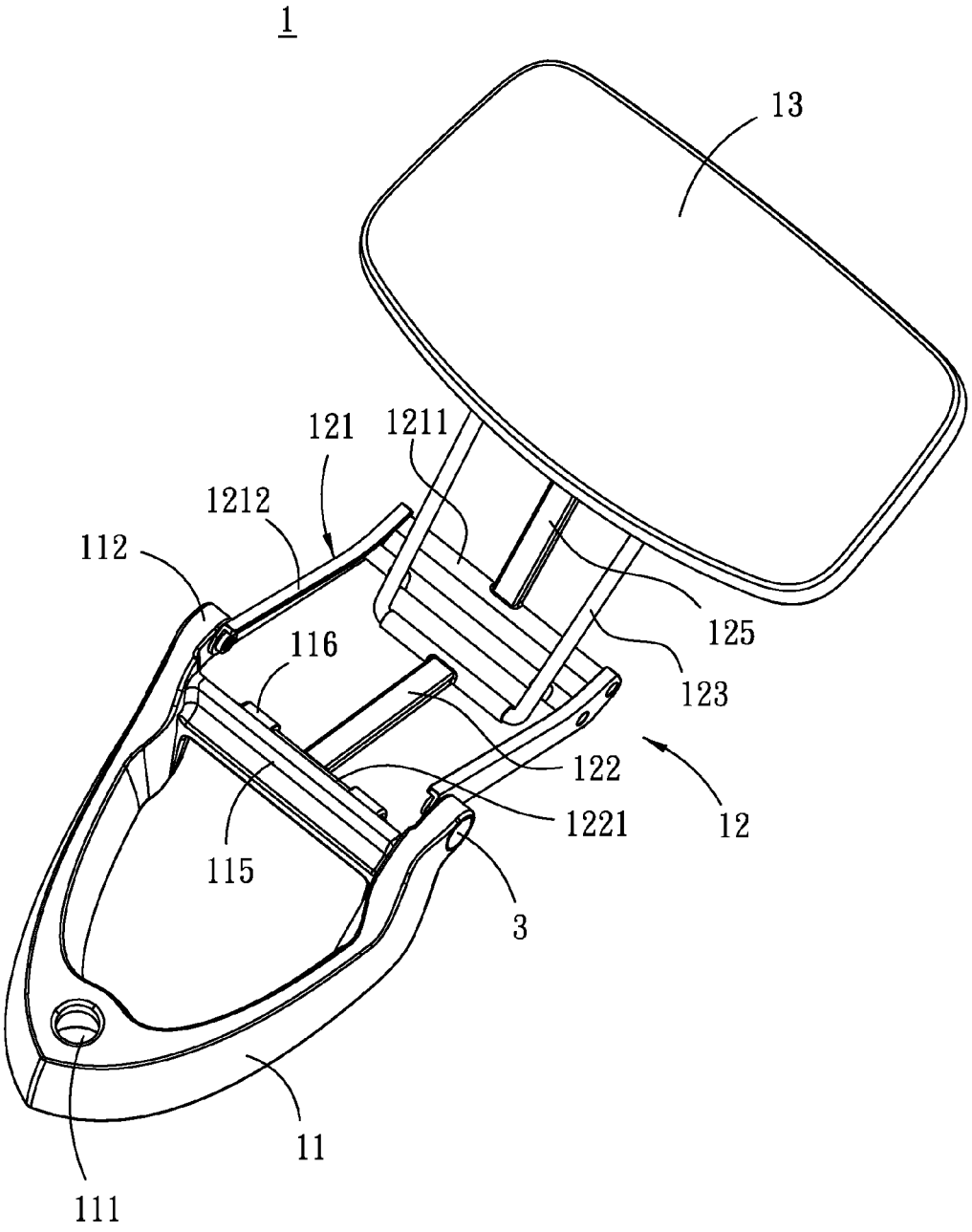
FIG. 3 is an assembled view of the invention.

The second support frame 123 is a U-shape. A transversal portion of the second support frame 123 is rotatably connected to the main board 1211. The second support frame 123 rotatably connects the support seat 124. The support seat 124 has a rectangular hollow 1241. Each of four corners of the support seat 124 is provided with a screw hole 1242. The bottom of the support seat 124 is provided with a transversal rod 1243 with a vertical rod 125. The vertical rod 125 is connected between the transversal rod 1243 and the main board 1211 so that the vertical rod 125 is rotatable with respect to the main board 1211. Finally, the support pad 13 is fixed onto the support seat 124. The bottom of the support pad 13 is provided with fixing holes 131 separately corresponding to the screw holes 1242. Thus, the support pad 13 can be fixed onto the support seat 124 by screws 5 as shown in FIG. 3.

Figure 4:
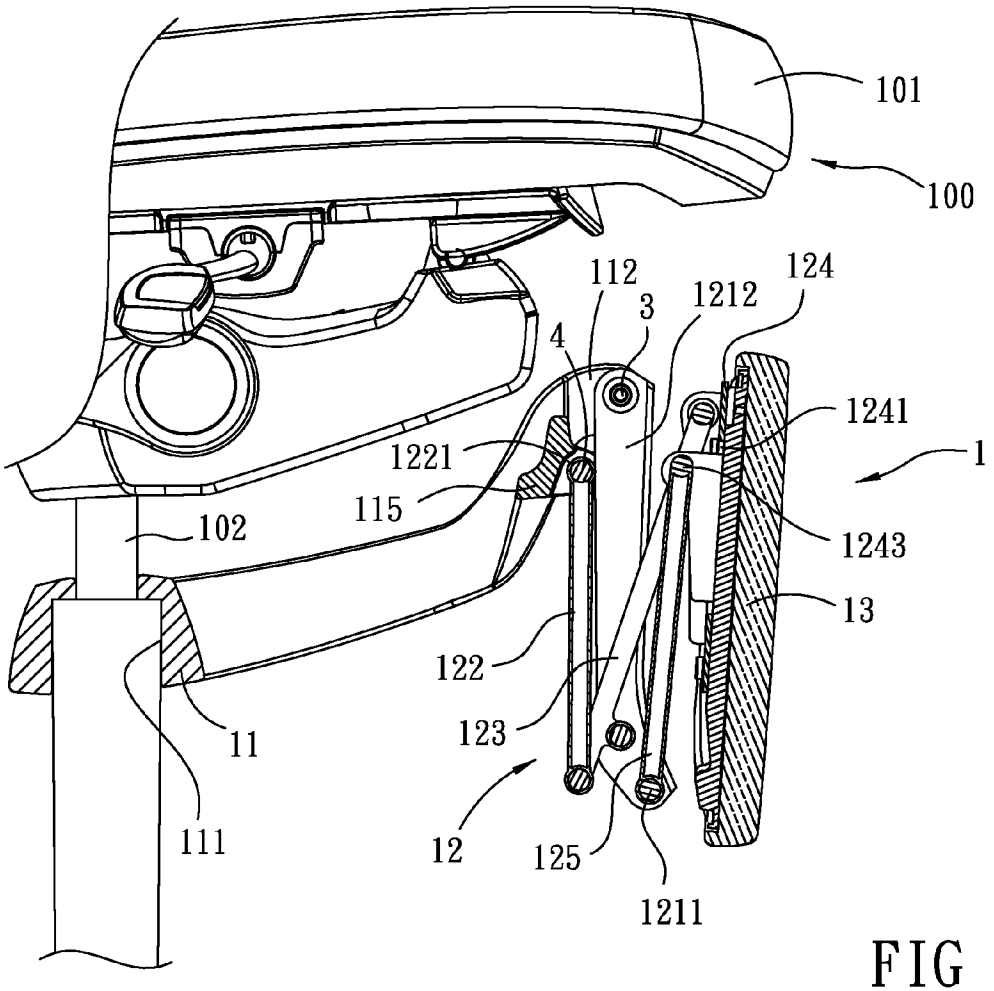
FIGS. 4-6 are side views showing the movement of the invention in operation
Figure 5:
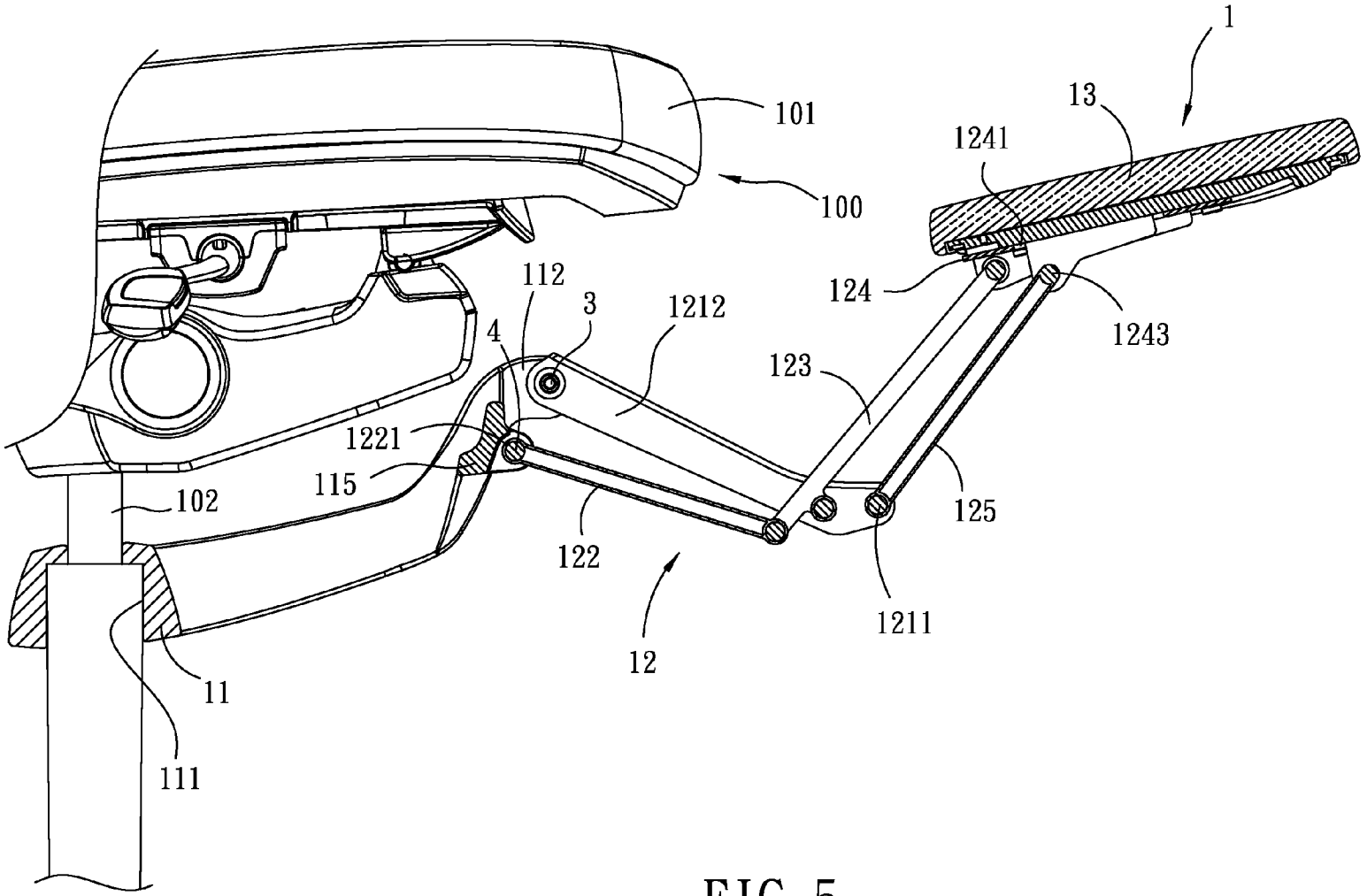
Figure 6:
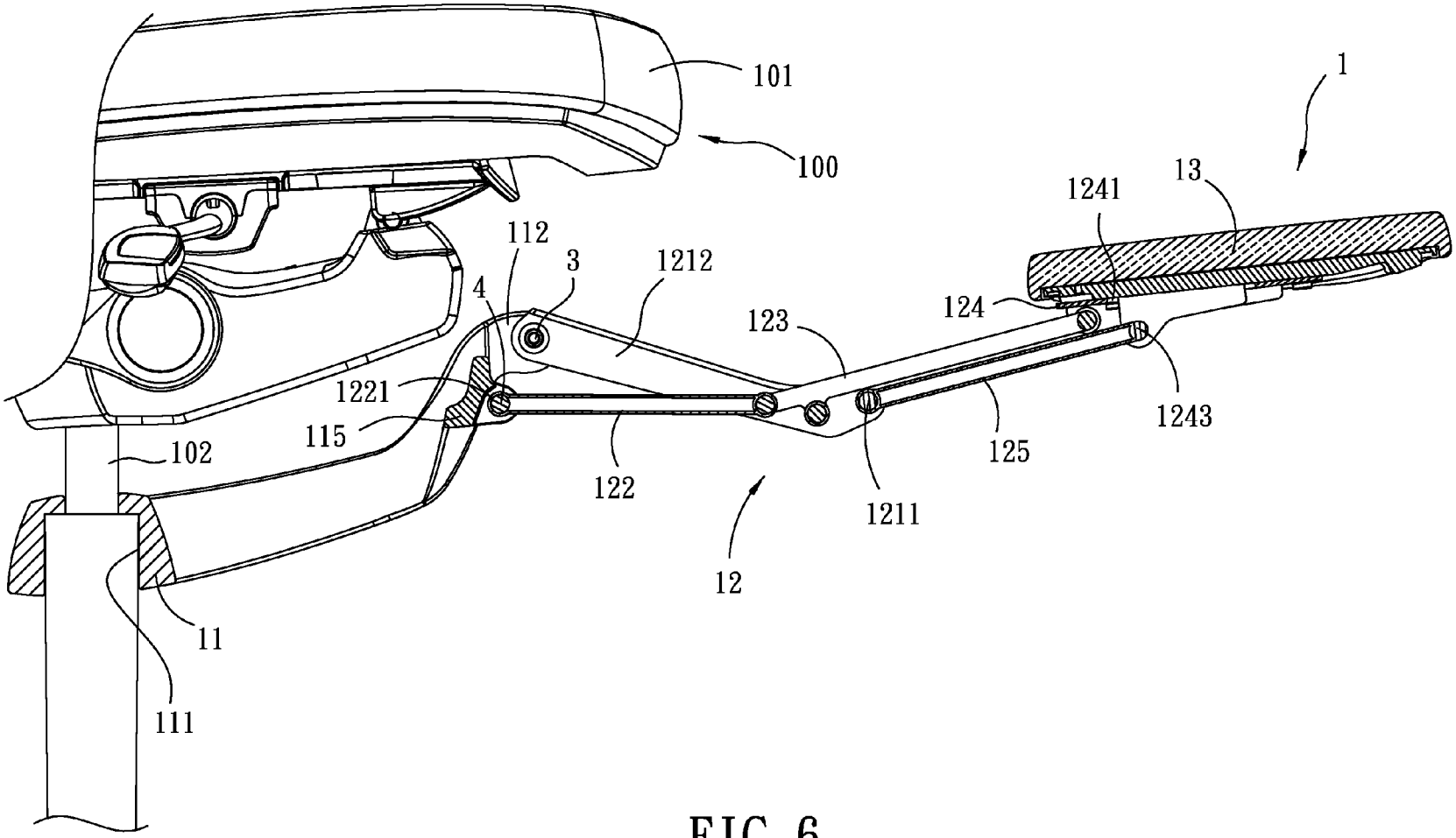

Please refer to FIGS. 4-6. As shown in FIG. 4 first, the leg rest 1 is completely retracted under the cushion 101 when the leg rest 1 is not needed. At this time, the retractable frame assembly 12 is overlapped with the support pad 13. When the leg rest 1 is needed to be used, as show in FIG. 5, a user can pull out the support pad 13 to stretch the second support frame 123 and the vertical rod 125 and to also stretch the first support frame 121. Finally as shown in FIG. 6, when the support pad 13 is completely pulled out, the link 122 is aligned with the second support frame 123. The position and angle of the support pad 13 can be adjusted by rotating the link 122, the second support frame 123 and the vertical rod 125. The base frame 11 and the first support frame 121 may provide auxiliary support to the support pad 13.

It will be appreciated by persons skilled in the art that the above embodiment has been described by way of example only and not in any limitative sense, and that various alterations and modifications are possible without departure from the scope of the invention as defined by the appended claims.

What is claimed is:

1. A retractable leg rest for a chair, comprising:

a base frame, having a first end and a second end, a through hole being formed in the first end for receiving a post of the chair, the second end being formed with two connecting sockets, a connecting rod being connected between the connecting sockets, and two hole seats being provided on the connecting rod;

a retractable frame assembly, connecting with the base frame, and comprising:

a first support frame, having two connecting arms and a main board connected therebetween, the connecting arms separately connected to the connecting sockets, a link perpendicularly extending from the main board, an outer end of the link is provided with a connecting tube, and the connecting tube being coaxially connected between the hole seats;

a second support frame, rotatably connected to the main board;

a support seat, rotatably connected to the second support frame, and having a transversal rod; and a vertical rod, perpendicularly connected between the transversal rod and the main board, and being rotatable with respect to the main board; and a support pad fixed onto the support seat.

2. The retractable leg rest of claim 1, wherein the base frame is of a U-shape.

3. The retractable leg rest of claim 1, wherein each of the connecting sockets is formed with a pivot hole with a cap, and the pivot hole is further formed with a threaded hole.

4. The retractable leg rest of claim 3, wherein an end of each connecting arm is formed with a passing hole, and a bolt is inserted into both the passing hole and the pivot hole and is screwed into the threaded hole so that the connecting arms are separately connected to the connecting sockets.

5. The retractable leg rest of claim 1, wherein the link is parallel with the connecting arms.

6. The retractable leg rest of claim 1, further comprising:

a shaft inserted through the hole seats and the connecting tube; and two screws, each being axially fastened into one end of the shaft, and the two screws holding the shaft and the link rotatable with respect to the connecting rod.

7. The retractable leg rest of claim 1, wherein the second support frame is of a U-shape.

8. The retractable leg rest of claim 1, wherein the support seat has a rectangular hollow, and each of four corners of the support seat is provided with a screw hole.

9. The retractable leg rest of claim 8, wherein a bottom of the support pad is provided with fixing holes separately corresponding to the screw holes so that the support pad is fixed onto the support seat by screws.

* * * * *